US005479985A

United States Patent [19]

Yamamoto et al.

[11] Patent Number: 5,479,985

[45] Date of Patent: Jan. 2, 1996

[54] HEAT EXCHANGER

[75] Inventors: Ken Yamamoto, Obu; Norimasa Baba, Nagoya; both of Japan

[73] Assignee: Nippondenso Co., Ltd., Kariya, Japan

[21] Appl. No.: 35,925

[22] Filed: Mar. 23, 1993

[30] Foreign Application Priority Data

| | | | |
|---|---|---|---|
| Mar. 24, 1992 | [JP] | Japan | 4-066351 |
| Apr. 7, 1992 | [JP] | Japan | 4-085735 |
| May 27, 1992 | [JP] | Japan | 4-134981 |

[51] Int. Cl.[6] ..... F28F 9/02

[52] U.S. Cl. ..... 165/176; 165/153

[58] Field of Search ..... 165/153, 176

[56] References Cited

U.S. PATENT DOCUMENTS

| | | | |
|---|---|---|---|
| 4,998,580 | 3/1991 | Guntly et al. | 165/133 |
| 5,174,373 | 7/1991 | Shinmura | 165/176 |

FOREIGN PATENT DOCUMENTS

| | | | |
|---|---|---|---|
| 3803599 | 8/1989 | Germany | 165/176 |
| 62-153685 | 7/1987 | Japan | 165/176 |
| 63-6392 | 1/1988 | Japan | 165/176 |
| 63-3192 | 1/1988 | Japan | 165/176 |
| 1-118093 | 9/1989 | Japan | 165/176 |
| 356061 | 5/1991 | Japan . | |
| 2166862A | 5/1986 | United Kingdom | 165/176 |

*Primary Examiner*—Allen J. Flanigan
*Attorney, Agent, or Firm*—Cushman, Darby & Cushman

[57] ABSTRACT

A tube has a plurality of coolant passages inside which are separated by inner struts at center into an inlet passage side and an outlet passage side in the longitudinal direction of a core. On one end side of the tube inserted in a header are formed an inlet port and an outlet port through the tube in the direction of core lamination on either of the inlet passage side and the outlet passage side.

Inside the header is disposed a separator, with the tube in an inserted state, in a position for separation between the inlet port and the outlet port of each tube. Since the header interior is divided to the front and rear sides of the core, there are formed, in the header, an inlet chamber communicating with a coolant passage on the inlet passage side through an inlet port, and an outlet chamber communicating with a coolant passage on the outlet passage on the outlet side through the outlet port.

5 Claims, 23 Drawing Sheets

HEAT EXCHANGER

BACKGROUND OF THE INVENTION

1. Field of the Invention

The present invention relates to a heat exchanger and is specially suitable for use as an evaporator, condenser, etc. of a refrigerating cycle mounted on a motor vehicle.

2. Description of the Related Art

In a prior-art heat exchanger used as a refrigerating-cycle condenser, evaporator, etc. mounted on a motor vehicle, a header section is located on one end of tubes forming refrigerant passages to change the configuration of a core to thereby allow easy installation of the heat exchanger in a narrow mounting space in an engine compartment. (Refer to Japanese Utility Model Laid-Open No. Hei 3-56061.)

In the laminated-type heat exchanger where the tubes and fins are alternately laminated with this header disposed on one end side of the tubes, as shown in FIG. 11, a partition plate 202 is attached by brazing to one end face of the tube 201 inserted in a header 200, thus separating the interior of the header 200 into an inlet side and an outlet side. The other end side of the tube 201 is covered with a capsule 203, and is connected to each coolant passage 204 formed in the tube 201.

Therefore, in this laminated-type heat exchanger, if the brazing position of the partition plate 202 is changed, the inlet side and the outlet side are connected within the header, requiring a high brazing accuracy. It is, therefore, difficult to seal the inlet and outlet sides within the header 200.

Generally, a stocked plate type heat exchanger is adopted in which, with two plates facing each other, the tubes and the header are formed together.

In this drawn-cup type heat exchanger, however, since the tubes and the header are made of the same thickness, when this heat exchanger is used for example as a condenser in which a high-pressure coolant flows, and is produced on the basis of the compressive strength of the header, the plate thickness of the tubes increases, resulting in an increase in weight and cost.

SUMMARY OF THE INVENTION

The present invention has been accomplished in view of the above-described circumstances and has as its object the provision of a heat exchanger having a header only on one end side of tubes, in which the inlet side and the outlet side in the header are separated without increasing weight and cost. For better understanding of the present invention as well as other objects and further features thereof, reference is had to the following drawings and description.

DESCRIPTION OF THE PREFERRED EMBODIMENTS

Figure 1:
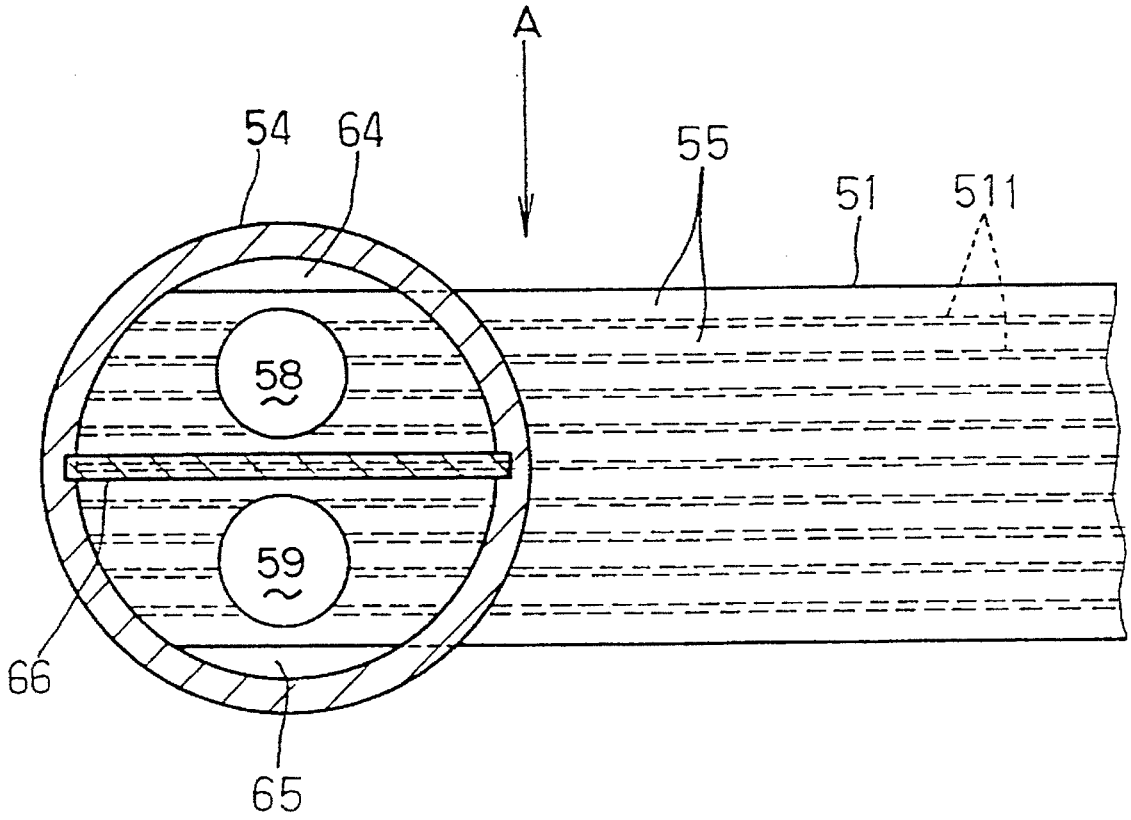
FIG. 1 is a sectional view showing the assembly of tubes with a header of a coolant condenser according to a first embodiment of the present invention.
Figure 2:
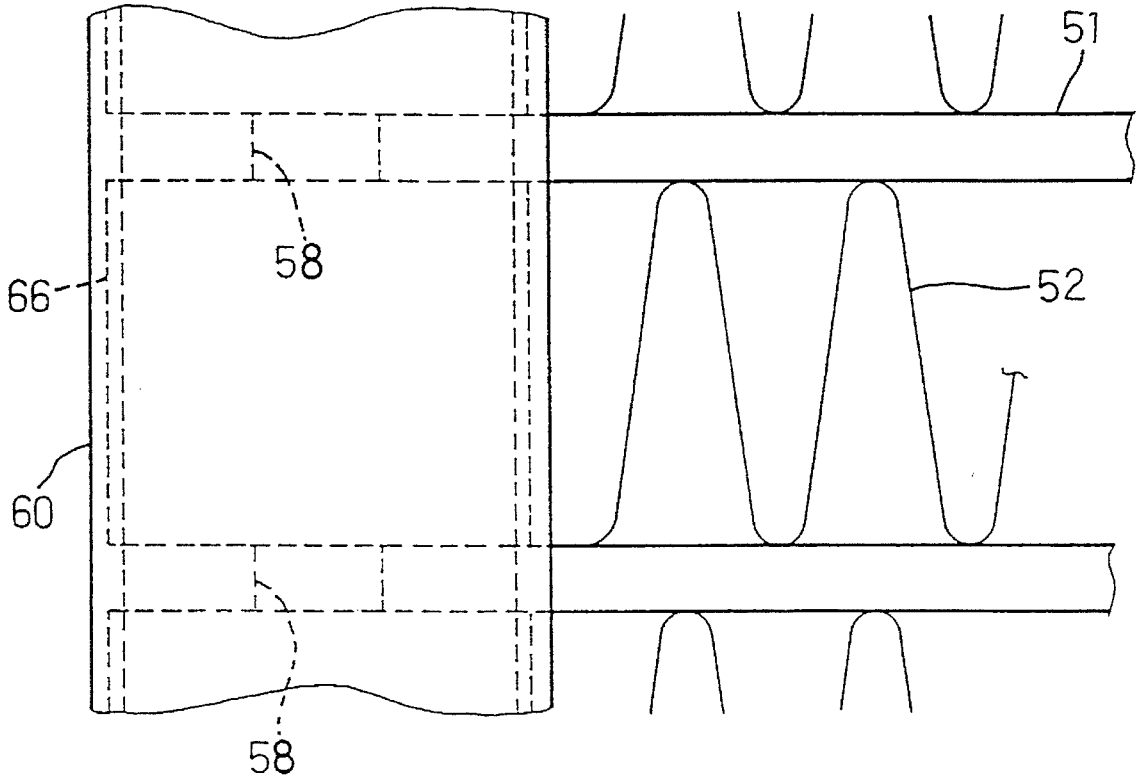
FIG. 2 is a view taken in the direction of arrow A in FIG. 1.

FIG. 1 is a sectional view showing the assembly structure of tubes and a header of a coolant condenser, and FIG. 2 is a view taken in the direction arrow A of FIG. 1.

Figure 3:
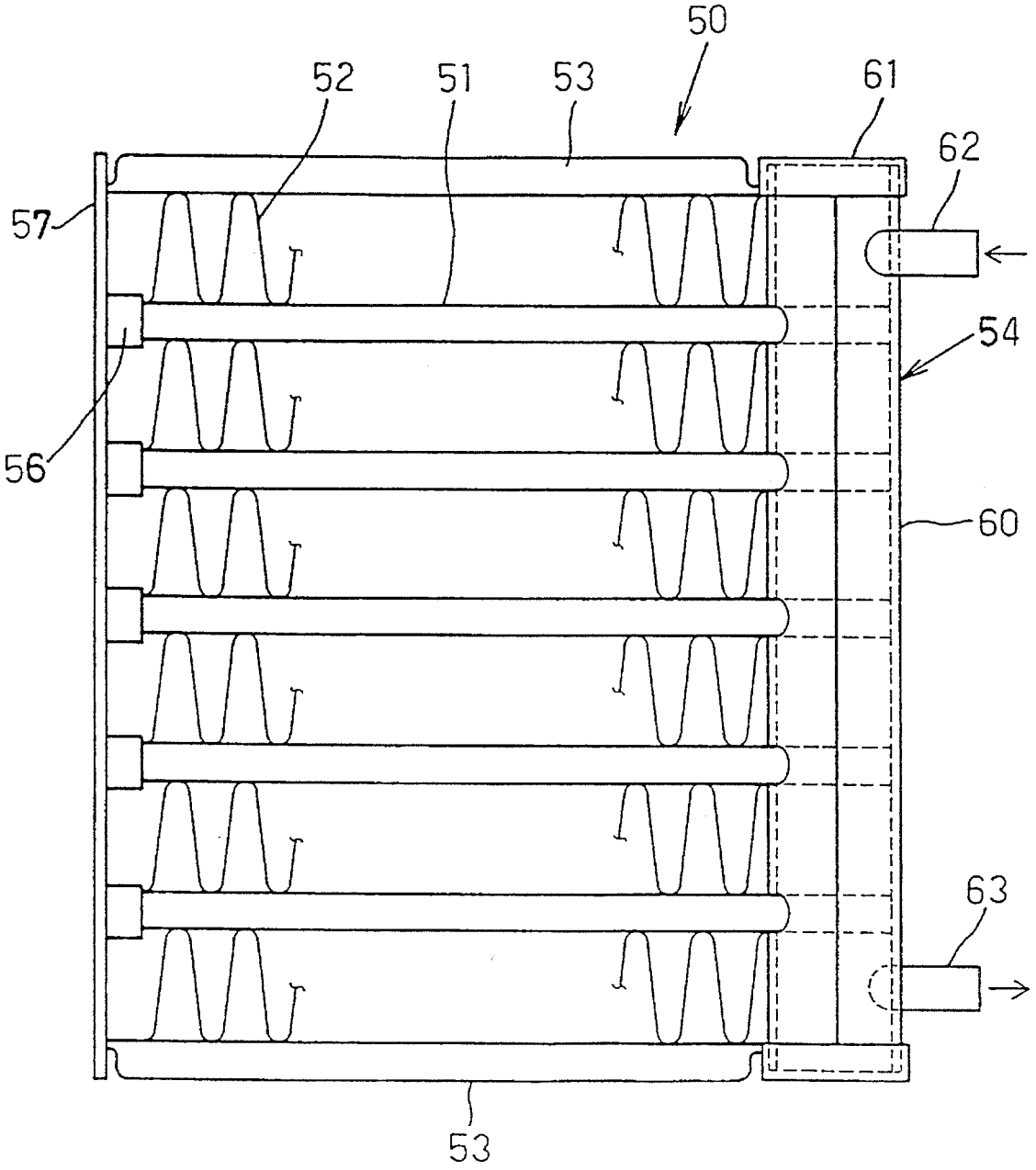
FIG. 3 is a front view of the coolant condenser used in to the first embodiment of the present invention.

A coolant condenser 50 of the present embodiment, as shown in FIG. 3 (front view of the coolant condenser 50), is comprised of a core including a number of tubes 51 and fins 52 which are alternately laminated and side plates 53 on both outer sides of a direction of lamination (vertical direction in FIG. 3), and one header 54 disposed on one side (on the right in FIG. 3) of the core.

Figure 4:
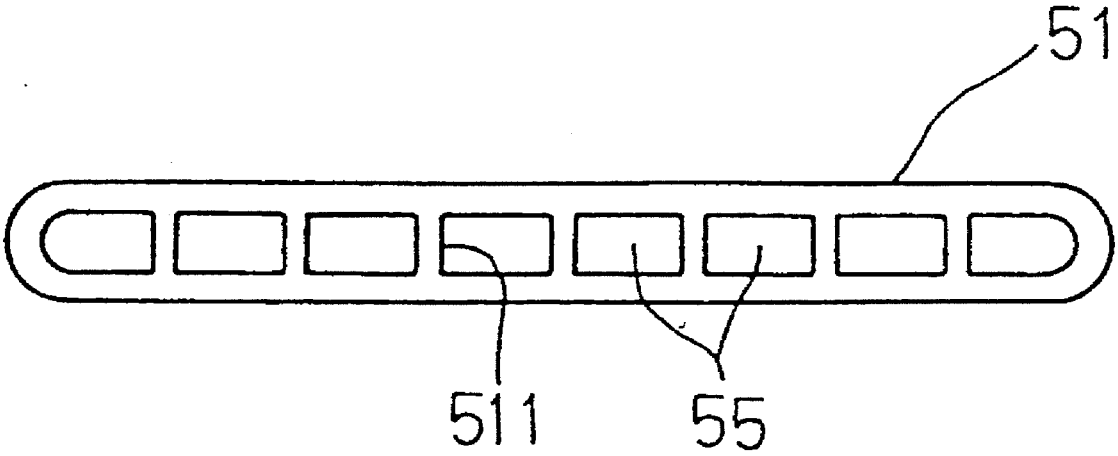
FIG. 4 is a sectional view of tubes of the coolant condenser used in to the first embodiment of the present invention.

Each tube 51 is an aluminum extrusion-molded product, in which a plurality of coolant passages (fluid passages in the present invention) separated by inner braces 511 are formed (see FIG. 4 showing the section of the tube 51). The outer peripheral surface is clad with a brazing material by thermal spraying. In a coolant passage 55 in a single tube 51 the coolant flows forward and backward; for this purpose, therefore, the coolant passage 55 is separated, at the inner brace 511 at center as a boundary, into a supply passage side (the upper half of FIG. 1) and an outlet passage side (the lower half of FIG. 1) in the longitudinal direction (in the vertical direction in FIG. 1) of the core. The tube 51 is inserted at one end side in the header 54; the end face thereof is brazed airtight on the inner wall surface of the header 54. Accordingly the end face of the tube 51 inserted in the header 54 is formed in the same shape corresponds to the sectional form of the inner wall of the header 54. The other end face of the tube 51 is covered airtightly with a capsule 56 so that the coolant passage 55 on the inlet passage side will be connected to the coolant passage 55 on the outlet side and supported on a bracket 57.

Also, on the end of the tube 51 inserted in the header 54 are formed an inlet port 58 and an outlet port 59 through the tube 51 in the direction of lamination of the core on the inlet passage side and the outlet passage side. The inlet port 58 and outlet port 59 are sized to include each coolant passage 55 on the inlet passage side and each coolant passage 55 on the outlet passage side (a size large enough to communicate with each coolant passage 55).

The fin 52 is a corrugated thin aluminum sheet formed with rollers, and provided on the surface with a louver (not illustrated) formed for increasing the heat transfer efficiency.

The header 54 is an aluminum header clad with a brazing material on both surfaces, comprising a cylindrical body 60 of a circular cylindrical form and a cap 61 for closing airtightly the openings in both ends of this cylindrical body 60. In the side face of the header 54 are formed a number of long holes (not illustrated) into which the end of each tube 51 is inserted. To the header 54 are attached by brazing an inlet pipe 62 communicating with the discharge port of the coolant compressor (not illustrated) and an outlet pipe 63 communicating with an inlet port of a receiver (not illustrated).

In the header 54 is installed a separator 66 (a partition wall of the present invention), with one end of the tube 51 in an inserted state, between the tubes 51 in the direction of lamination of the core, between the uppermost tube 51 and the upper cap 61, and between the lowermost tube 51 and the lower cap 61, separating the interior of the header 54 in the front and rear directions of the core to thereby form an inlet chamber 64 and an outlet chamber 65 within the header 54. This separator 66 is produced of a sheet cut to a specific size and clad with a brazing material on both sides, and inserted in mounting grooves (not illustrated) provided in the inner wall surface of the header 54, in a position for separation between the inlet port 58 and the outlet port 59 of each tube 51. Therefore, the inlet chamber 64 defined in the header 54 communicates with each coolant passage 55 on the inlet passage side through the inlet port 58 of each tube 51, while the outlet chamber 65 communicates with each coolant passage 55 on the outlet passage side through an outlet port 59 of each tube.

The inlet pipe 62 described above is installed in the upper part of the header 54 communicating with the inlet chamber 64 in the header 54, while the outlet pipe 63 is installed in the lower part of the header 54 communicating with the outlet chamber 65 in the header 54.

Next, the flow of the coolant flowing in the coolant condenser will be explained.

A high-temperature, high-pressure coolant being discharged from the coolant compressor flows from the inlet pipe 62 into the inlet chamber 64 within the header 54 then, the coolant is distributed to each tube 51 through the inlet port 58 of each tube 51 from the inlet chamber 64. The coolant distributed to each tube 51 makes a U-turn at the other end of the tube 51 after flowing in each coolant passage 55 on the inlet passage side, into each coolant passage 55 on the outlet passage side. The coolant flowing in each coolant passage 55 on the inlet and outlet passage sides is cooled into a liquid through heat exchange with the air supplied into the coolant condenser 50 through the fins 52, being gathered into an outlet chamber 65 in the header 54 from each outlet port 59 and flowing out through the outlet pipe 63.

Since this coolant condenser 50 has the header 54 only on one end side of the tube 51, the square core configuration shown in FIG. 3 can be changed by changing the length of each tube 51. Accordingly, this type of coolant condenser 50 is advantageous when mounted within the engine compartment having a great mounting space limitation.

In this coolant condenser 50 the interior of the header 54 is separated into the inlet chamber 64 and the outlet chamber 65 by the separator 66 placed between the inlet port 58 and the outlet port 59 of the tube 51. Therefore, the provision of a larger spacing than the width of the separator 66 between the inlet port 58 and the outlet port 59 can absorb displacement of the brazing position of the separator 66 in the longitudinal direction of the core. Also since the separator 66 can be joined in a T-section to the outer peripheral surface of the tube 51, brazing can be exactly performed. That is, it is possible to more easily seal the inlet chamber 64 side and the outlet chamber 65 side in the header 54 as compared with the prior-art laminated-type heat exchanger which requires a high brazing accuracy. Furthermore, since the coolant condenser 50 of the present invention is of the laminated type to facilitate the arrangement of header 54 only on the one end of the tube 51, the tube 51 and the header 54 can be manufactured separately. Accordingly the plate thickness of the tube 51 and the header 54 can be set to a desired value; unlike the prior-art stacked plate type heat exchanger, it is unnecessary to make the plate thickness of the tube 51 the same value as that of the header 54. Consequently the plate thickness of the tube 51 will not require an unnecessarily large increase in plate thickness. Making an appropriate plate thickness can reduce weight and cost of the coolant condenser 50.

Figure 6:
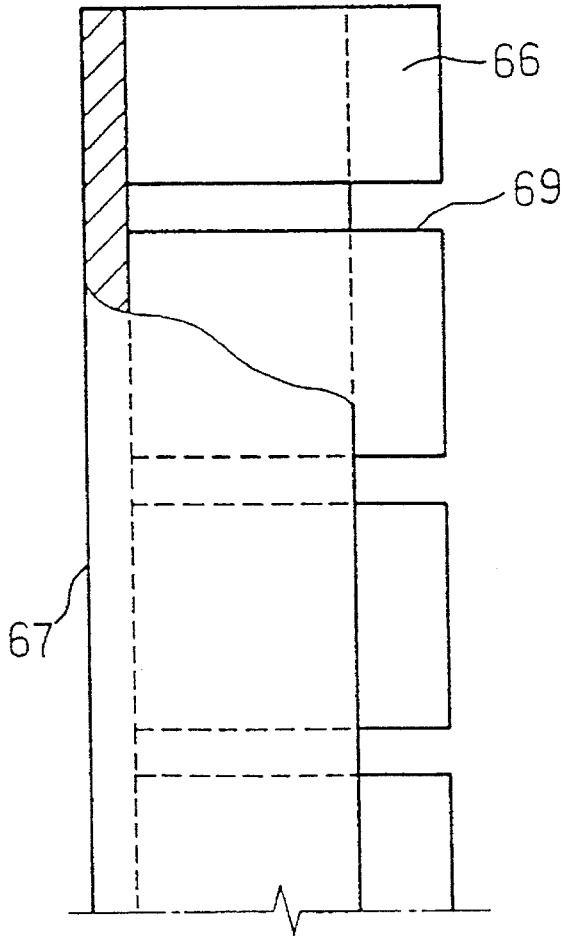
FIG. 6 is a side view of a tank header used in the second embodiment of the present invention.
Figure 7:
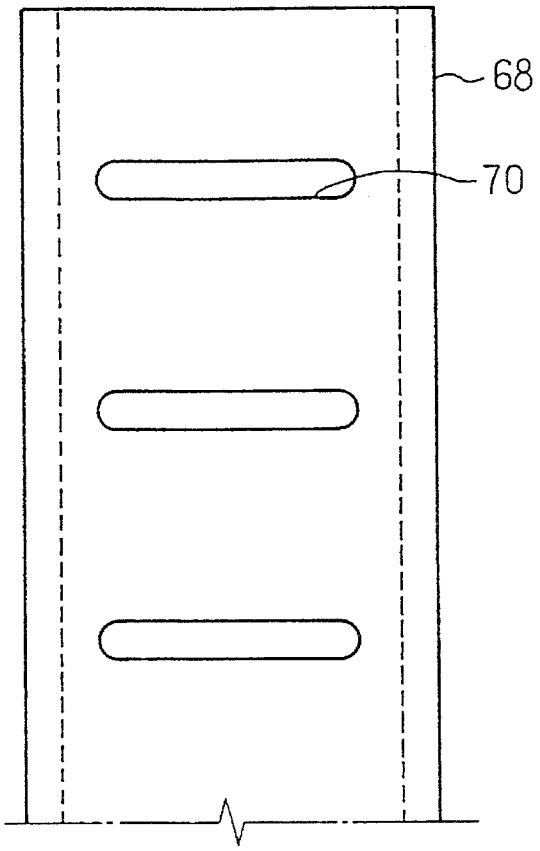
FIG. 7 is a front view of a plate header used in the second embodiment of the present invention.

Next, a second embodiment of the present invention will be explained with reference to FIGS. 5 to 7.

Figure 5:
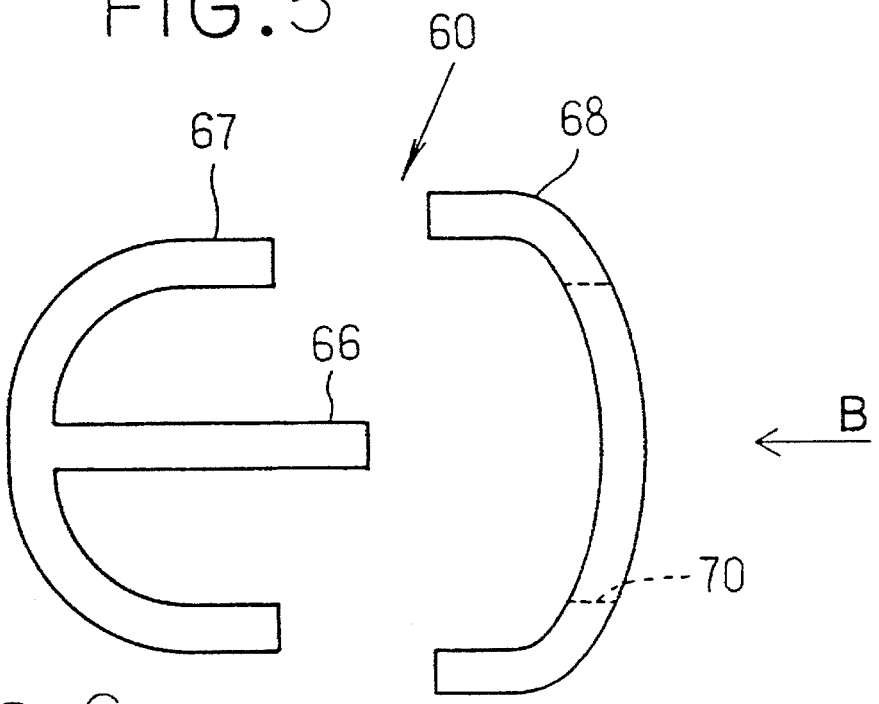
FIG. 5 is an exploded plan view of a cylindrical body forming a header pertaining to a second embodiment of the present invention.

FIG. 5 is an exploded plan view of the cylindrical body 60 forming the header 54.

In the coolant condenser 50 of the present invention, the cylindrical body 60 forming the header 54 is a split type, consisting of a tank header 67 and a plate header 68 as shown in FIG. 5.

The tank header 67 is formed integral with the separator 66 shown in the first embodiment. After being formed nearly in a form of an E-section by extrusion molding, a slit 69 is cut in a portion where the tube 51 will be inserted (refer to FIG. 6 showing the side view of the tank header 67).

The plate header 68 is a plate-like header having a gently curved sectional form. On the bottom surface (side surface) there is formed a long hole 70 in which the end portion of each tube 51 will be inserted in a position corresponding to the slit 69 formed in the tank header 67 (refer to FIG. 7 which is a view taken in the direction of B in FIG. 5).

The tank header 67 and the plate header 68, as shown in FIG. 5, form the cylindrical body 60 by installation with their opening sides facing each other. The opening section at both ends of the cylindrical body 60 is closed with the cap 61, thus forming the header 54.

The end portion of the tube 51 inserted into the header 54 through a long hole 70 which is formed in the plate header 68 is inserted into the slit 69 of the tank header 67, and is attached by brazing with the end face of the tube 51 in contact with the inner wall surface of the header 54.

In this embodiment also, it is possible to obtain the same effect as the first embodiment.

MODIFIED EXAMPLE

Figure 8:
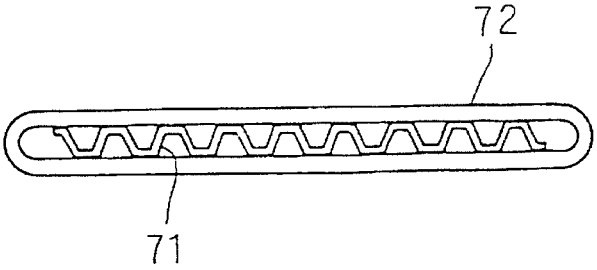
FIG. 8 is a sectional view showing a variation of the tubes used in the present invention.

In the above-described embodiment, the tube 51 produced by extrusion molding has been explained. As shown in FIG. 8, an aluminum welded tube 72 with an inner fin 71 inserted and brazed inside may be used.

Figure 9:
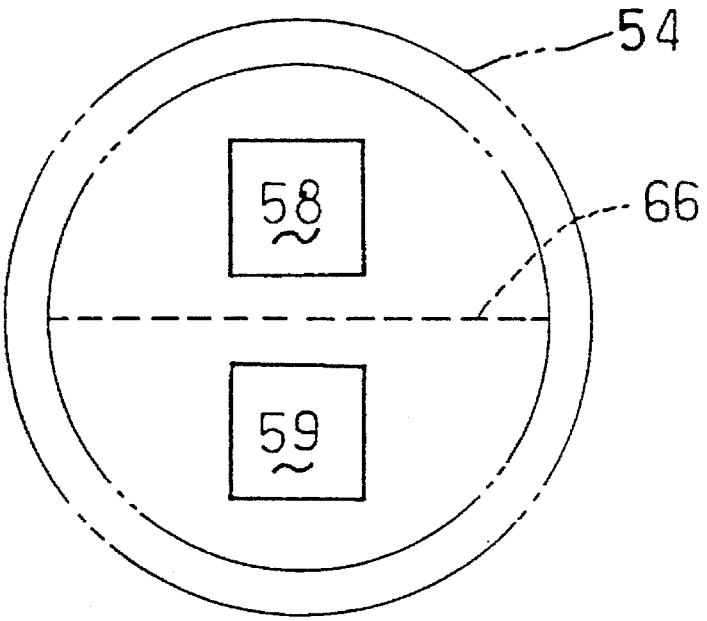
FIG. 9 is a plan view showing a variation of inlet and outlet ports formed in the tubes pertaining to the present invention.
Figure 10:
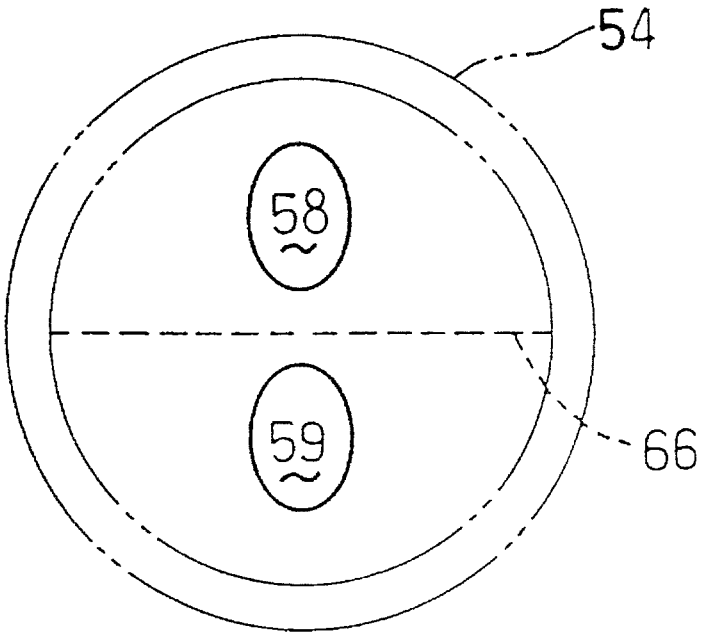
FIG. 10 is a plan view showing a variation of the inlet and outlet ports formed in the tubes pertaining to the present invention.
Figure 11:
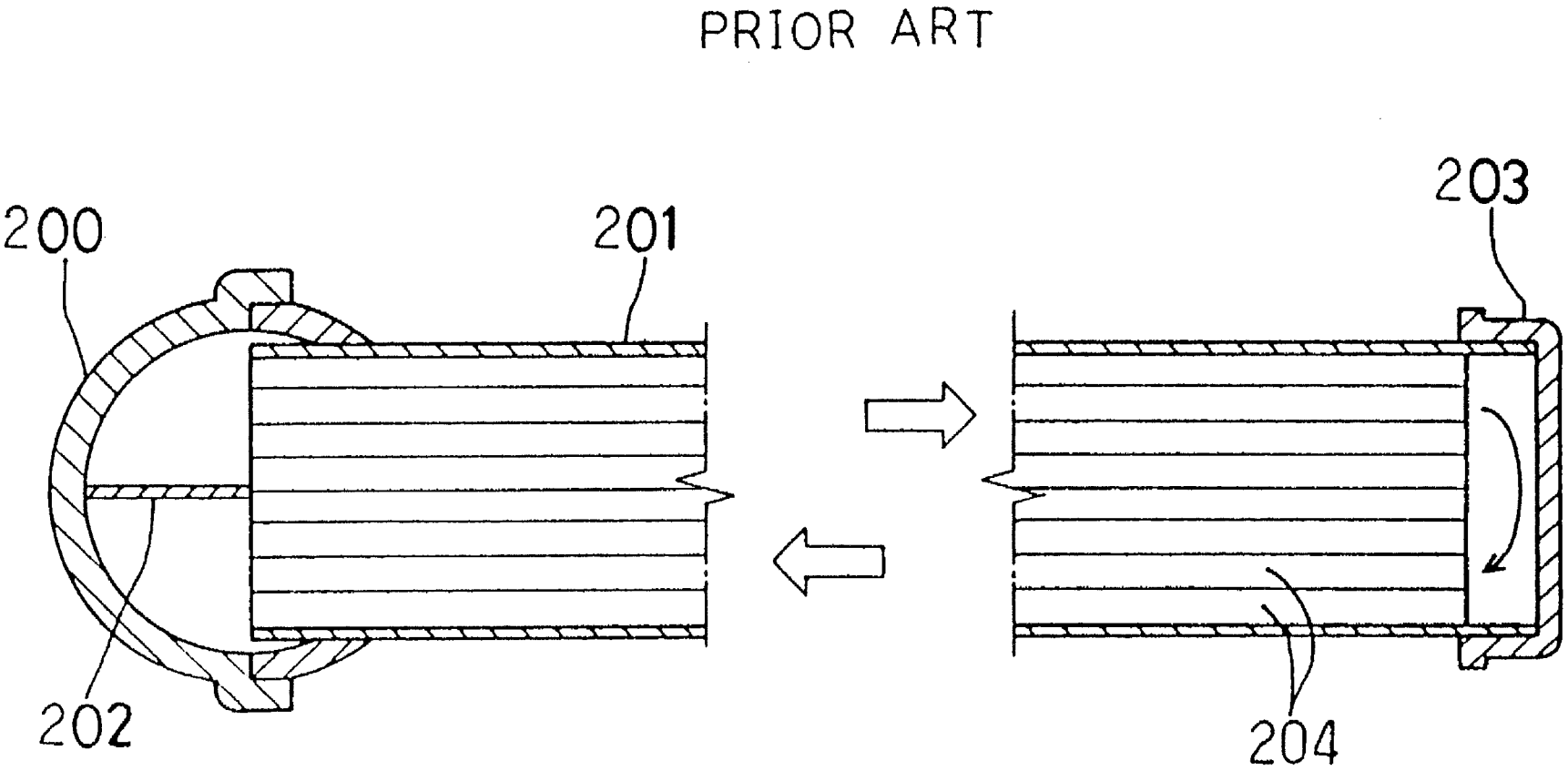
FIG. 11 PRIOR ART
FIG. 11 is a sectional view showing a structure for connecting the tubes and the header of the laminated-type heat exchanger pertaining to a conventional device.
Figure 12:
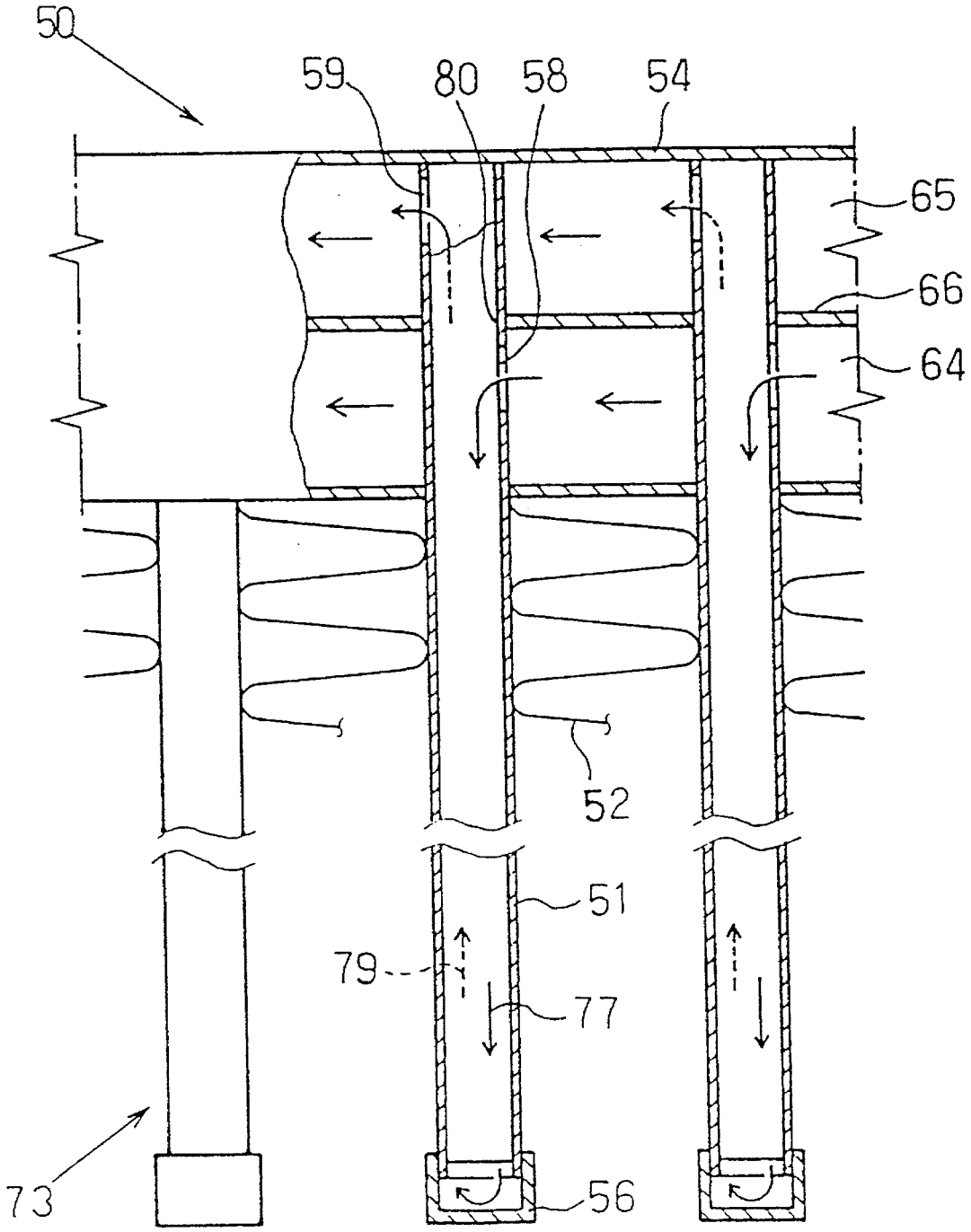
FIG. 12 is a front sectional view showing a coolant condenser adopted as a third embodiment of the present invention.
Figure 13:
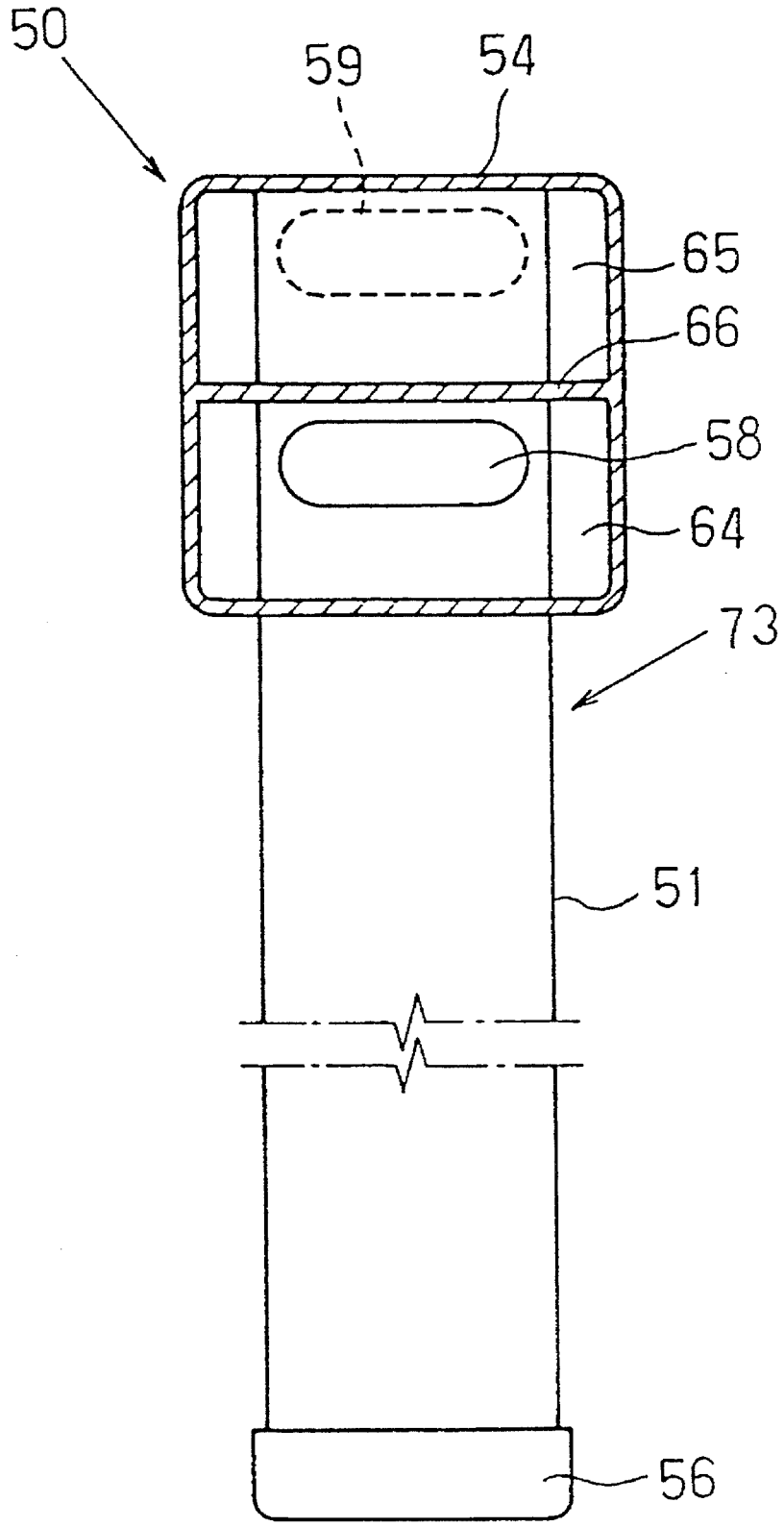
FIG. 13 is a side sectional view of the coolant condenser according to the third embodiment of the present invention.
Figure 14:
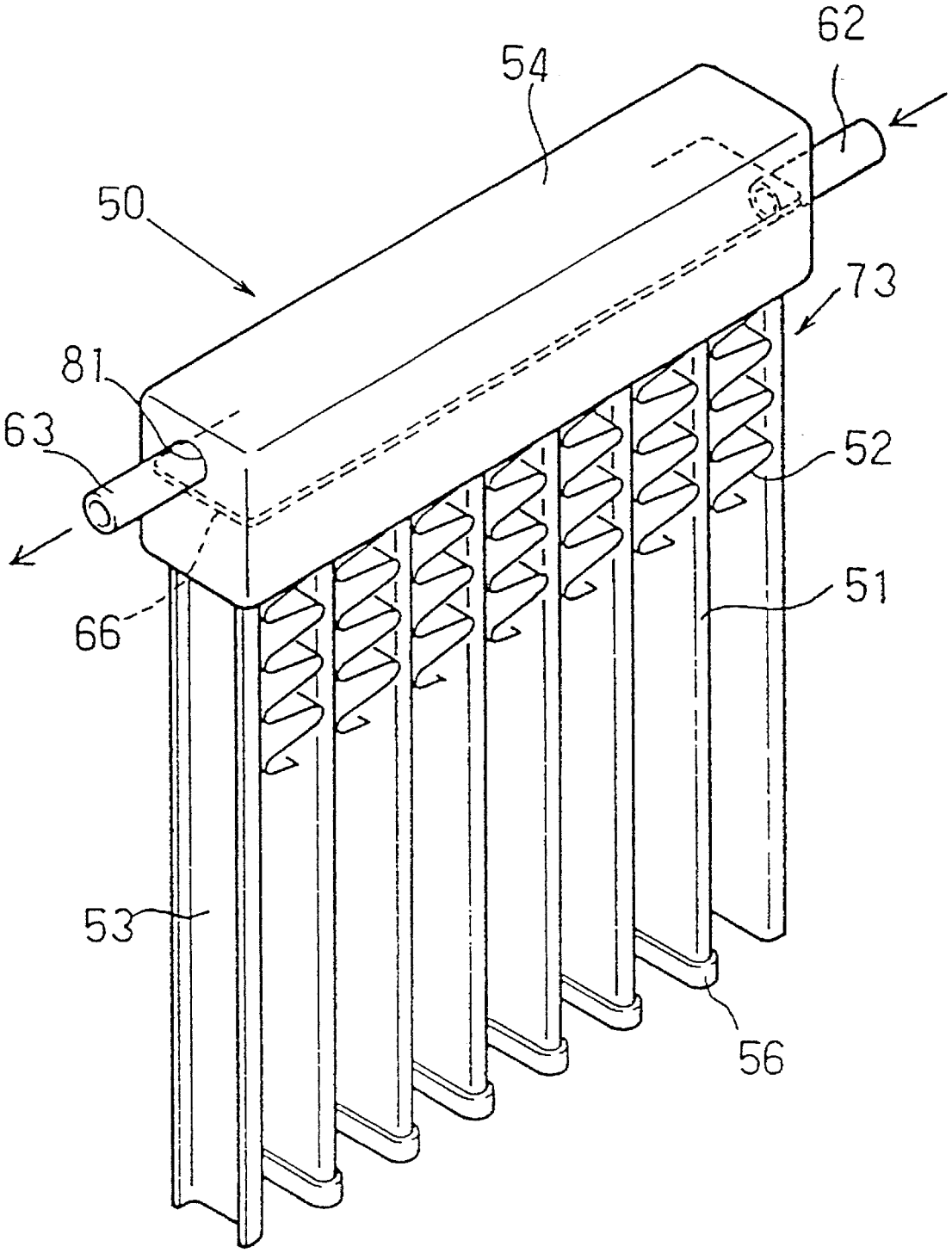
FIG. 14 is a perspective view of the coolant condenser according to the third embodiment of the present invention.

The inlet port 58 and the outlet port 59 provided in one end side of the tube 51 may be square (or may be rectangular) as shown in FIGS. 9 and 10 with respect to addition to the circular ones stated in the first embodiment.

Since the header 54 can keep strength by the provision of the separator 66, it is possible to adopt the other sectional form than the circular form shown in the first embodiment. For example, when a rectangular sectional form is adopted, the end face of the tube 51 to be inserted into the header 54 can be securely brazed to the inner wall surface of the header 54.

In the heat exchanger described above, the header is disposed only on one end side of the tube and therefore the core configuration may be changed in accordance with a mounting space, insuring the separation of the header interior into the inlet side and the outlet side without increasing weight and cost.

FIGS. 12 to 19 show a third embodiment of the present invention.

The coolant condenser 50 includes a core section 73 where heat is exchanged between the coolant and the air, and one two-stage header 54 is disposed only on one end side of this core section 73. Furthermore, core section 74 is manufactured by brazing, after assembling, the core section 73, the header 54 and the side frame 53 together in a furnace.

In the core section 73, a plurality of tubes 51 arranged in a plurality of rows in the direction of width and corrugated fins 52 joined by brazing between two adjacent tubes 51 and having a louver (not illustrated) on the surface for increasing the heat transfer coefficient are alternately laminated to form a square front shape.

Figure 15:
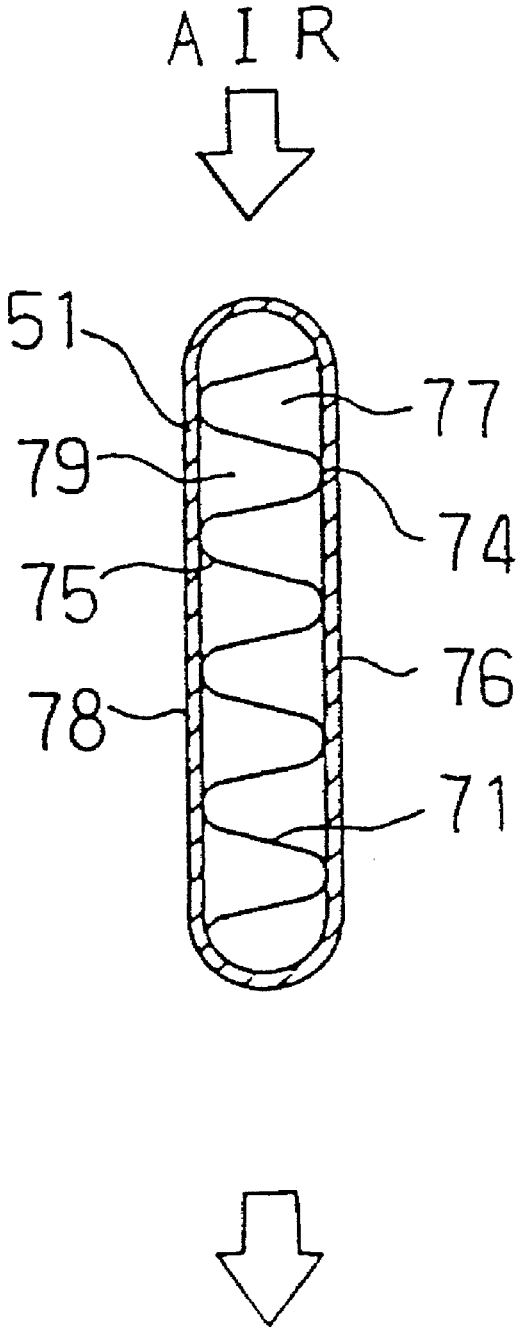
FIG. 15 is a sectional view showing the tubes assembled in the coolant condenser.

FIG. 15 is a view showing the tubes 51 assembled in the coolant condenser 50.

The tube 51 is an aluminum tube of a flat elliptical sectional form, and clad with a brazing material over the inner and outer surfaces. On the surface (the right side surface in FIG. 12) of one end of this tube 51 is formed the inlet port 58 of approximately elliptical form, and on the back side (the left side surface in FIG. 12) on one side of the tube 51 is formed an outlet port 59 of approximately elliptical form. The inlet port 58 and the outlet port 59 are formed by cutting, opening in the header 54. The header 54 is so set that the opening position of the inlet port 58 will be below the opening position of the outlet port 59 in FIG. 12.

One end face and the other end face of the tube 51 are open; the one end face is joined and closed by brazing to the inner wall of the header 54, while the other end face is covered with the capsule 56 to make a U-turn of the coolant flowing inside. Inside of the tube 51, the inner fin 71 is joined by brazing.

Figure 16:
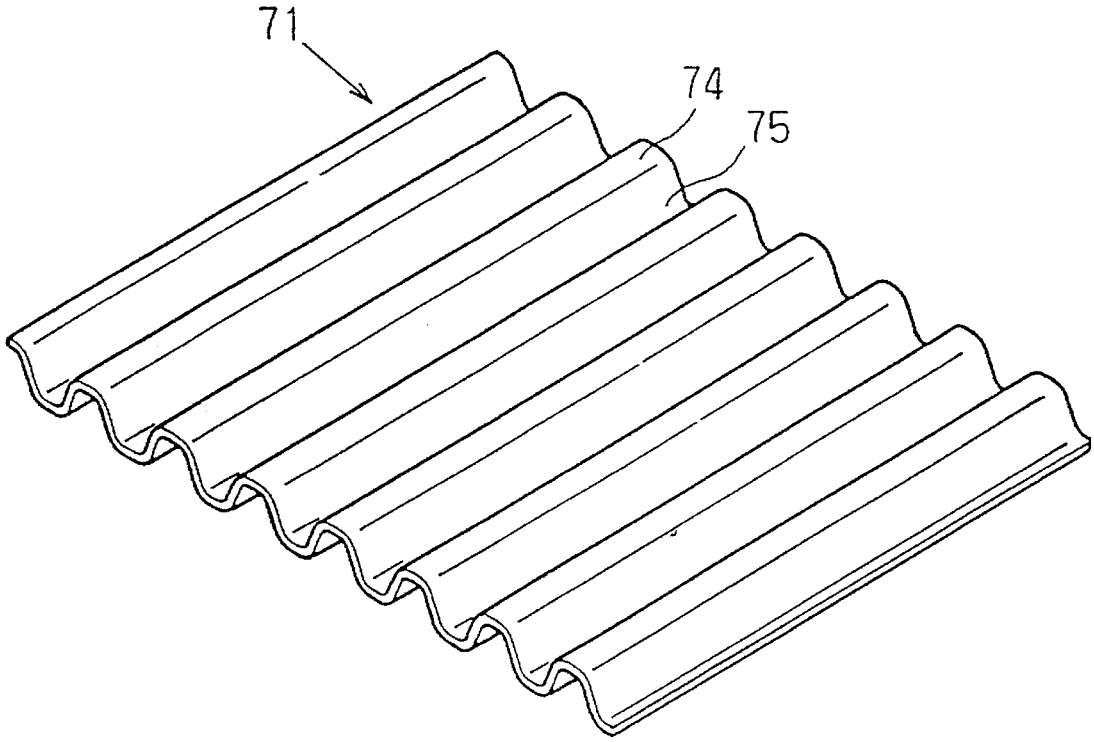
FIG. 16 is a schematic view showing inner fins installed in the tubes.

FIG. 16 is a view showing the inner fin 71 installed on the tube 51.

The inner fin 71 is produced of a thin corrugated plate folded having repetitively alternating ridges 74 and grooves 75 in a direction in which they meet the longitudinal direction of the tube 51. In the interior of the tube 51, a plurality of small-diameter fluid passages are formed in parallel with the longitudinal direction of the tube 51. Furthermore, the inner fin 71 serves to exchange heat between the coolant which flows in a plurality of small-diameter inlet passages 77 (indicated by a full line along an arrow in FIG. 12) formed between the fins and a side wall (the side wall 76 on the right, disposed in a direction meeting at right angles with the direction of air flow in FIG. 15) on the surface side of the tube 51 and the coolant which flows in a plurality of small-diameter outlet passages 79 (indicated by a broken line along an arrow in FIG. 12) formed between the fins and the side wall (the side wall 78 on the left, disposed in a direction meeting at right angles with the direction of flow of the air in FIG. 15) on the back side of the tube 51.

The header 54 is an aluminum extrusion-molded product of a square sectional form, thus forming the separator 66 inside. This separator 66 separates the interior of the header 54 into two stages in the longitudinal direction (vertical direction in FIG. 12) of the tube 51, forming the inlet chamber 64 on the lower side in FIG. 12 and the outlet chamber 65 on the upper side in FIG. 12.

The inlet chamber 64 serves as a distribution chamber for distributing the coolant to each tube 51, communicating with a plurality of small-diameter passages 77 through the inlet port 58 formed on one end side of each tube 51. In the meantime, the outlet chamber 65 forms a concentration chamber for concentrating the coolant from each tube 51, communicating with a plurality of small-diameter outlet passages 79 through the outlet port 59 formed on one end side of each tube 51.

In the right wall section of the header 54 corresponding to the right end section of the inlet chamber 64 is formed a circular hole (not illustrated). In this circular hole is inserted the inlet pipe 62 (see FIG. 14) for feeding a high-temperature, high-pressure overheated gas discharged from the coolant compressor (not illustrated) into the header 54.

In the left wall section of the header 54 corresponding to the left end section of the outlet chamber 65 is formed a circular hole 81, in which is inserted the outlet pipe 63 for feeding the condensate into a pressure reducing device (not illustrated).

Figure 17:
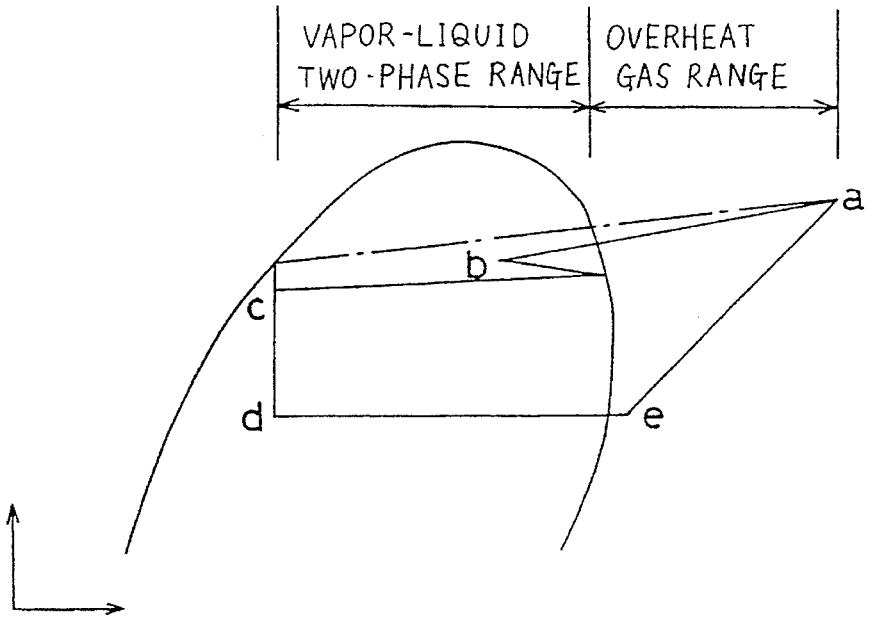
FIG. 17 is a Mollier diagram showing the condition of the coolant.

Next, the function of this coolant condenser 50 will be briefly explained with reference to FIGS. 12 to 19. FIG. 17 gives a Mollier diagram showing the state of the coolant with this coolant condenser 50 assembled in the refrigeration cycle (not illustrated).

The high-temperature, high-pressure overheated gas (the state point a in FIG. 17) discharged from the coolant compressor flows into the inlet chamber 64 of the header 54 from the inlet pipe 62, from which the overheat gas will be distributed to each tube 51 through the inlet port 58 of a plurality of tubes 51 from the inlet chamber 64. The overheated gas distributed to each tube 51 flows toward the other end of the tube 51 within a plurality of small-diameter passages 77 formed of the inner fins 71 on the surface side of the tube 51. Thereafter, the overheated gas makes a U-turn at the capsule 56 (the state point b in FIG. 17), flowing toward one end side of the tube 51 within a plurality of small-diameter passages 79 formed on the back side of the tube 51.

Then, the heat of the overheated gas is transferred to the air which is flowing in the core section 73 through the corrugated fins 52, being cooled and liquefied into a condensate. This condensate flows into the outlet pipe 63 after flowing into the outlet chamber 65 of the header 54 through the outlet port 59. Further, the vapor-liquid coolant (the state point c in FIG. 17) flowing out of the outlet pipe 63 is reduced in pressure into a low-temperature, low-pressure atomized coolant (the state point d in FIG. 17). The atomized coolant is vaporized when passing through a coolant evaporator (not illustrated), turning into a coolant gas (the state point e in FIG. 17) to be absorbed into a coolant compressor.

The overheated gas flowing into each tube 51 transfers its heat to the air passing through the core 73 by means of the corrugated fins 52 when passing through a plurality of small-diameter passages 77, being cooled and liquefied into a condensate.

This condensate turns back at the capsule 56, and when passing through inside the plurality of small-diameter outlet passage 79, exchanges heat with overheated gas which is passing through a plurality of small-diameter inlet passage 77 by means of the inner fins 52.

Therefore, normally the coolant condition varies as indicated by an alternate long and short dash line in FIG. 17. In the present embodiment, however, the heat is transferred from the overheated gas passing through a plurality of small-diameter inlet passages 7 to the condensate passing through inside a plurality of small-diameter outlet passages 79, thereby heating the condensate as indicated by a full line in FIG. 17. Accordingly, the liquid component of the coolant in a plurality of small-diameter inlet passages 77 increases, and reversely the gas component in a plurality of small-diameter outlet passages 79 increases.

Figure 18A:
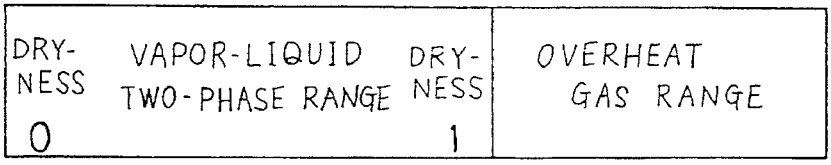
FIG. 18 (A) is an explanatory view showing an overheat gas range and a vapor-liquid two-phase range within the tubes where no heat exchange takes place in the tubes.
FIG 18(B) is an explanatory view showing an overheat gas range and a vapor-liquid two-phase range within the tubes where the heat exchange is effected in the tubes.
Figure 18B:
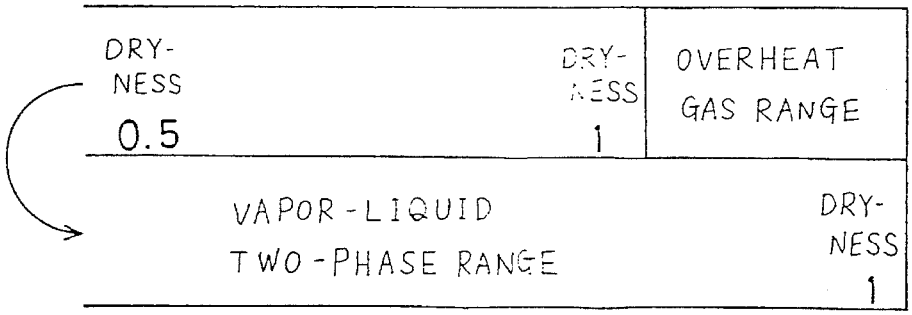

Consequently, the ratio of the overheat gas range to the vapor-liquid two-phase range within the tube 51 shifts from the state (a prior pattern) shown in FIG. 18(A) to the state shown in FIG. 18(B), thereby raising the dryness of the coolant on the vapor-liquid two-phase range side. That is, a part of the dryness 1 of the vapor-liquid two-phase range in a plurality of small-diameter inlet passage 77 shifts to one end of the tube 51, moving the dryness in the vicinity of the capsule 56 to about 0.5 and accordingly the dryness on one end side of the tube 51 of a plurality of small-diameter outlet passages 79 will increase to as high as about 1.

Figure 19:
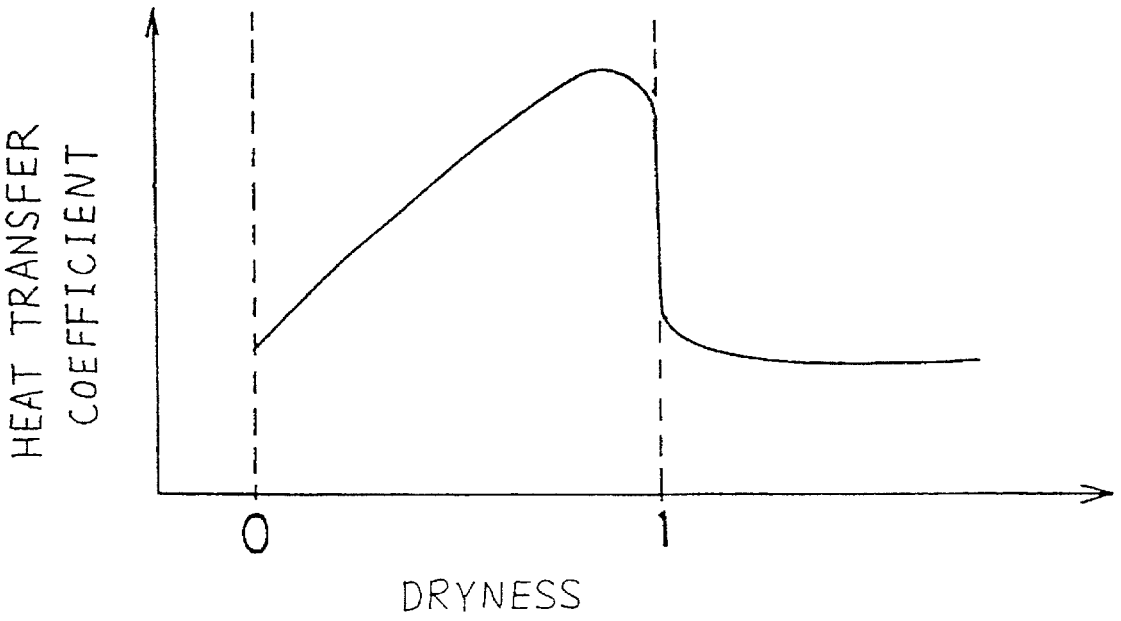
FIG. 19 is a graph showing a relationship between a heat transfer coefficient and dryness on the coolant side.

Therefore, as shown in the graph in FIG. 19, the range of high heat transfer coefficient on the coolant side, that is, the vapor-liquid two-phase range near the dryness of 1 is increased to thereby improve the heat exchange coefficient (heat dissipation performance) of the coolant condenser 50.

Since this coolant condenser 50 is mounted with the two-stage header 54 only on one-end of a plurality of tubes 51, it is possible to use the coolant condenser having an irregular front shape by changing the length of each tube 51. The coolant condenser 50, therefore, can be mounted very easily within the engine compartment having a limited mounting space.

Also when the header 54 is extrusion-molded, the separator 66 is molded en bloc in the longitudinal direction of the header, that is, in the direction of width of the core section 73; and the inlet port 58 and the outlet port 59 are formed in the front and back surfaces on one end side of the tube 51. Therefore if the mounting position of the separator 66 is shifted, the inlet chamber 64 and the outlet chamber 65 within the header 54 can be fully separated. It is therefore possible to easily seal the inlet chamber 64 and the outlet chamber 65 within the header 54 as compared with a prior-art heat exchanger which requires a high brazing accuracy.

Because this coolant condenser 50 is of such a construction that the header 54 is connected only to one-end of a plurality of tubes 51, the header 54 and a plurality of tubes 51 can be manufactured separately. Therefore, the plate thickness of the header 54 and the tube 51 can be arbitrarily set. It is unnecessary to produce the tube 51 of the same plate thickness as the header 54.

Therefore, the tube 51 will unnecessarily be increased in plate thickness even when the plate thickness is set on the basis of the compressive strength of the header 54 as the coolant condenser 50 in which the high-pressure coolant is flowing. Use of tubes of optimum plate thickness can reduce the weight and cost of the coolant condenser 50.

Figure 20:
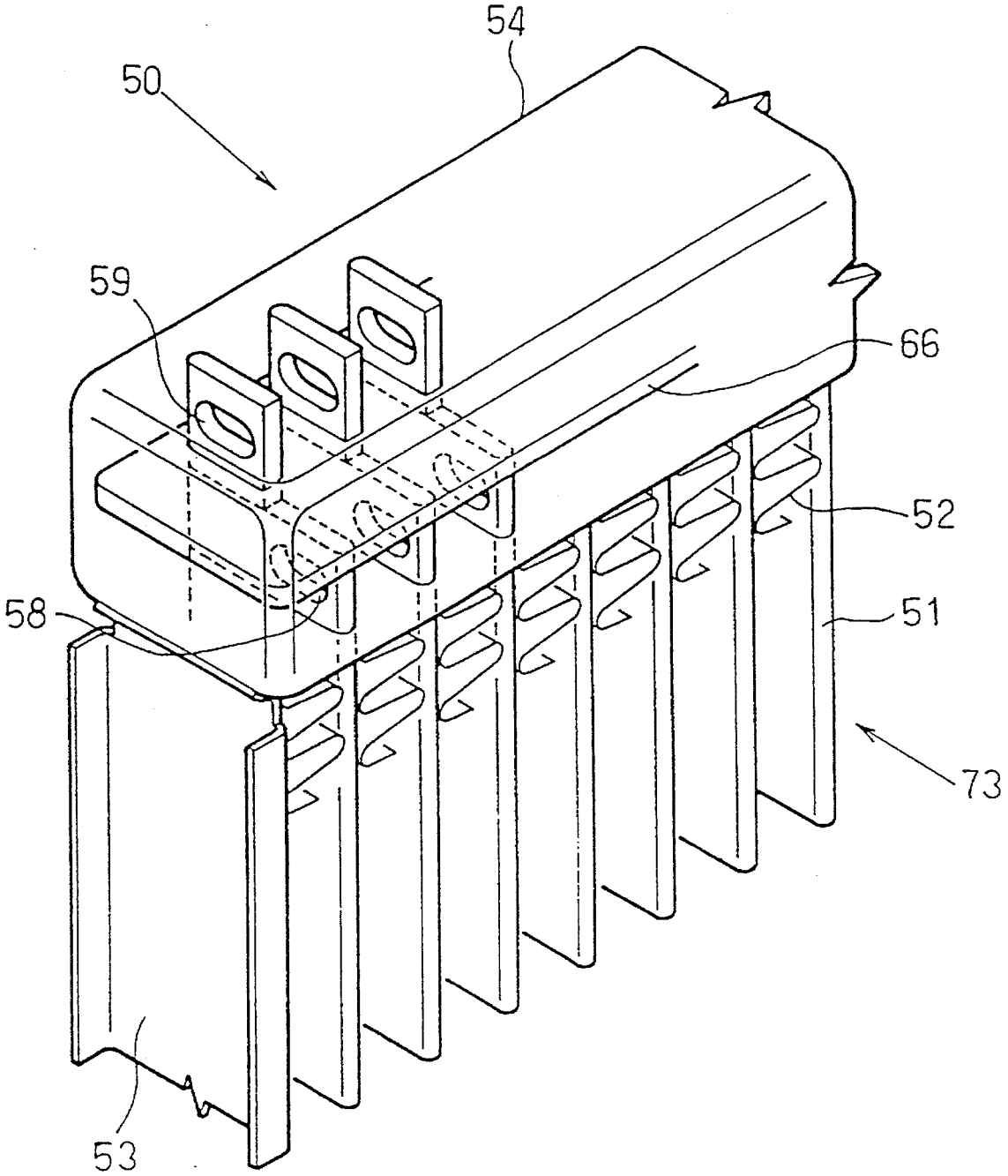
FIG. 20 is a perspective view showing a coolant condenser according to a fourth embodiment of the present invention.
Figure 21:
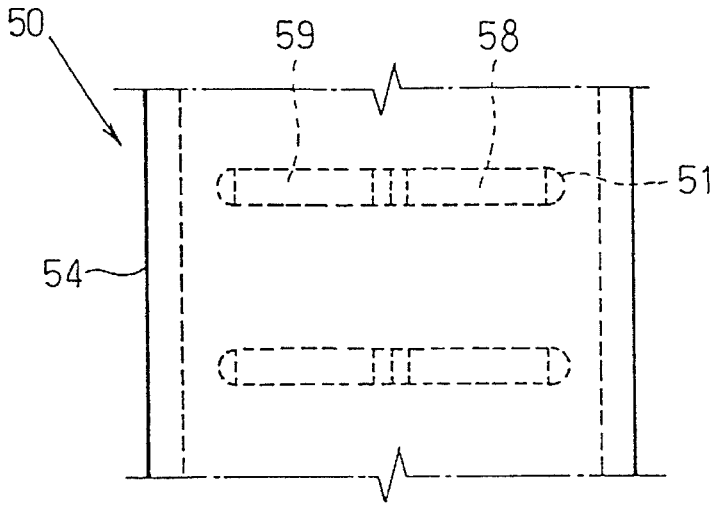
FIG. 21 is a plan view showing the coolant condenser according to the fourth embodiment of the present invention.
Figure 22:
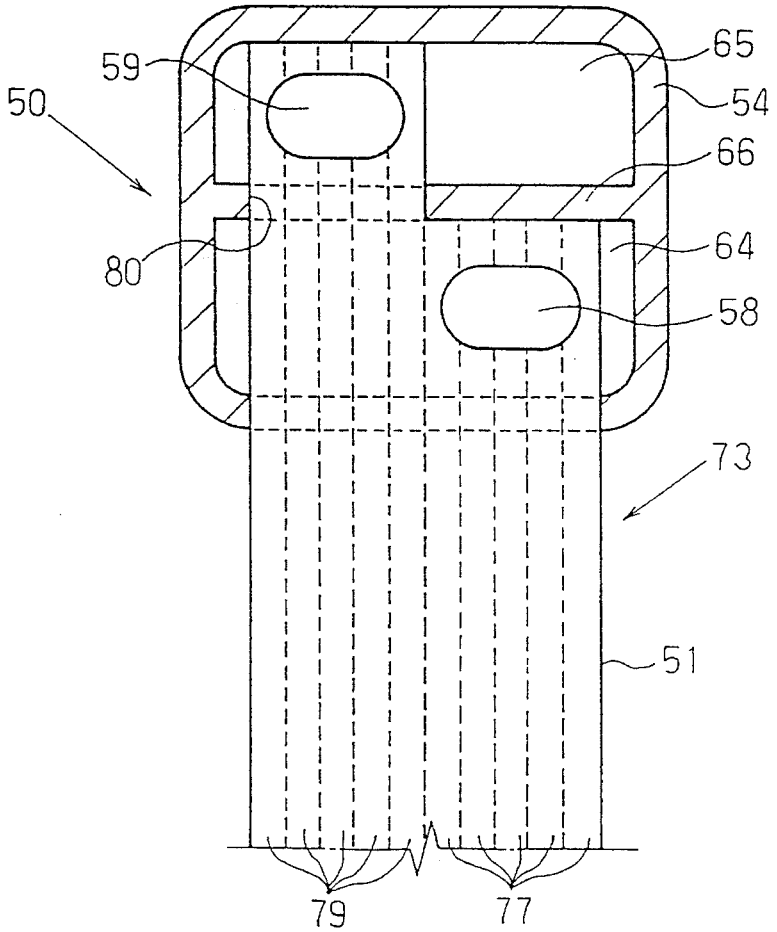
FIG. 22 is a sectional view showing the coolant condenser according to the fourth embodiment of the present invention.

FIGS. 20 to 22 are views showing a coolant condenser assembled in an air-conditioning apparatus for motor vehicles according to a fourth embodiment of the present invention.

In the tube 51 of this coolant condenser 50, a plurality of small-diameter passages are formed, by inner fins (not illustrated) or by extrusion molding, in a direction meeting at right angles with the longitudinal direction of the tube 51. The upstream side (front side) of the direction of air flow in these small-diameter passages serves as a plurality of small-diameter inlet passages 77 for sending the coolant from one end side to the other side of the tube 51. Also, the downstream side (rear side) in the direction of air flow in a plurality of small-diameter passages serves as a plurality of small-diameter outlet passages 79 for sending the coolant from the other end side to one end side of the tube 51.

One end on the forward side of the tube 51, corresponding to the one end section of a plurality of small-diameter inlet passages 77, is connected by brazing to the lower end of the separator 66 of the header 54. Also, one end on the forward side of the tube 51, corresponding to the one end section of a plurality of small-diameter outlet passages 79, is connected by brazing to the lower end of the inner wall of the header 54 through a through hole 80 of the separator 66 of the header 54.

Furthermore, in the front and back surfaces on the forward side at one end side of the tube 51 inserted in the header 54 is formed an elliptical inlet port 58 for communicating the inlet chamber 64 of the header 54 with a plurality of small-diameter inlet passage 77. Also, in the front and rear surfaces on the rear side at one end side of the tube 51 is formed an elliptical outlet port 59 for communicating the outlet chamber 65 of the header 54 with a plurality of small-diameter outlet passages 79.

Thus adopting the coolant condenser 50 of such a construction can reliably prevent sealing properties for sealing the inlet chamber 64 and the outlet chamber 65 in the header 54 from lowering in case of defective brazing of the inner wall of the header 54 to the one-end surface of the tube 51.

Figure 23:
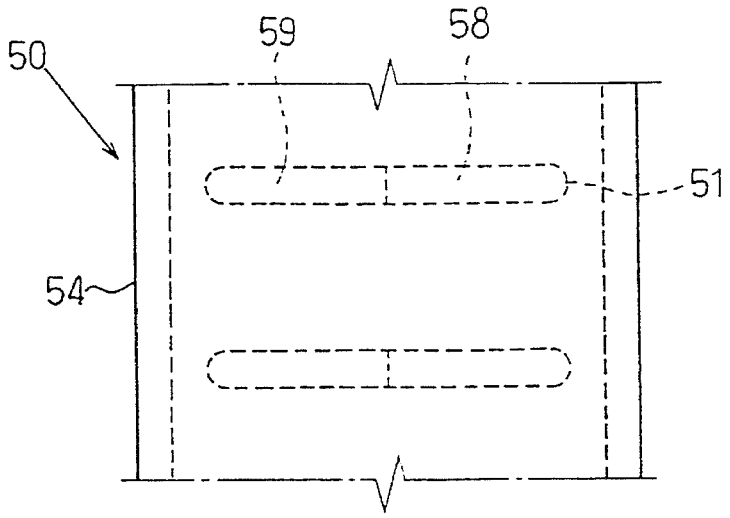
FIG. 23 is a plan view showing a coolant condenser according to a fifth embodiment of the present invention.
Figure 24:
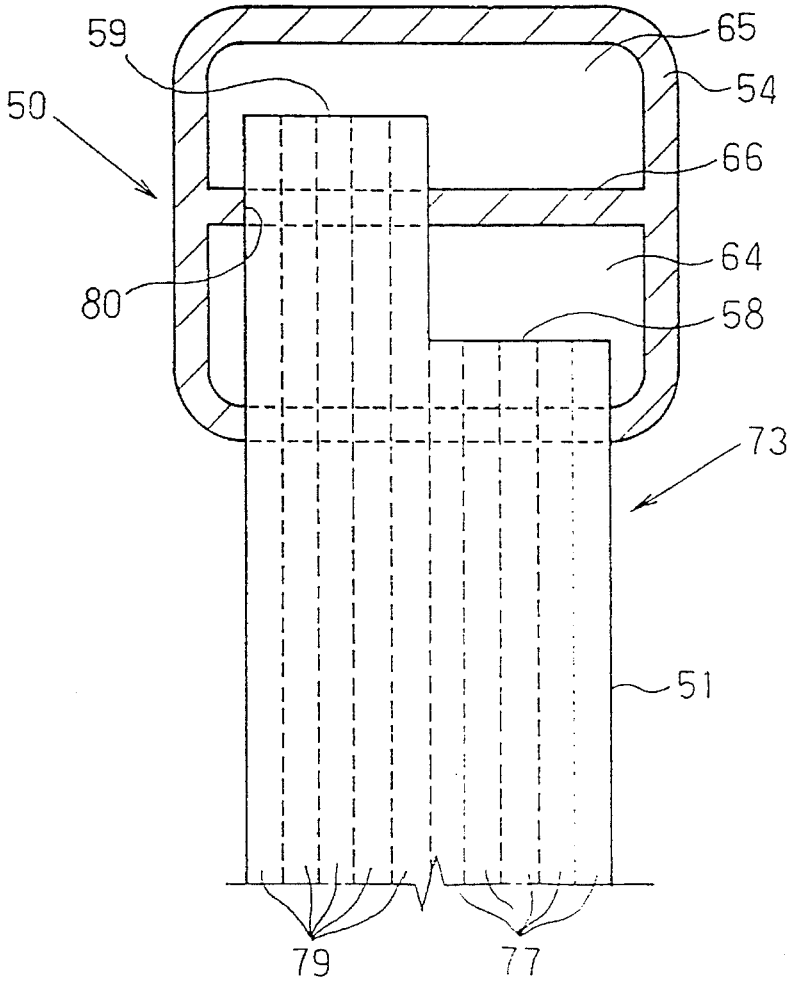
FIG. 24 is a sectional view showing the coolant condenser according to the fifth embodiment of the present invention.

FIGS. 23 and 24 are views showing the coolant condenser mounted in air-conditioning equipment for motor vehicles according to a fifth embodiment of the present invention.

Inside the tube 51 of this coolant condenser are formed a plurality of small-diameter inlet passages 77 and a plurality of small-diameter outlet passages 79 as in the case of the fourth embodiment.

One end on the forward side of the tube 51, corresponding to one end section of a plurality of small-diameter inlet passages 77, is set so as to be positioned inside of the inlet chamber 64 of the header 54. Also, one end on the forward side of the tube 51, corresponding to one end section of a plurality of small-diameter outlet passages, is so set as to be located inside of the outlet chamber 65 of the header 54 through the through hole 80 of the separator 66 of the header 54.

Furthermore, in one end face on the forward side of the tube 51 inserted in the header 54 are formed a plurality of inlet ports 58 for communication between the inlet chamber 64 of the header 54 and a plurality of small-diameter inlet passages 77. Also, in one end face at the rear side of the tube 51 are formed a plurality of outlet ports 34 for communication between the outlet chamber 65 of the header 54 and a plurality of small-diameter outlet passages 79.

In the present embodiment, the header and the partition wall are formed integrally by extrusion molding, but the header and the partition means may be joined by such a means as brazing after separate molding.

In the present embodiment, the header of square sectional form is adopted, but a header of circular, oblong, elliptical or polygonal section may be used. The sectional form of the tubes also may be changed; the inlet and outlet ports of the tubes also may be changed in shape as desired.

In the present embodiment, the two-stage header having the inlet chamber in the lower stage and the outlet chamber in the upper stage, but a two-stage header having an outlet chamber in the lower stage and an inlet chamber in the upper stage may be adopted. The partition means may be mounted in an inclined position if the inlet and outlet chambers have been formed such that the tubes will be arranged in two stages in the longitudinal direction. For example, the separator may be mounted inclined so that the inlet chamber will become narrower as it goes away from the inlet piping.

In the present embodiment, a plurality of parallel small-diameter passages are formed in parallel within a tube by providing inner fins in the tube, but may be formed within the tube by use of an extrusion-molded tube.

In the present embodiment, the present invention is applied to the coolant condenser, but may be applied also to other heat exchangers of a coolant evaporator, radiator, heater core, oil cooler, etc. Furthermore, a fluid for heat exchange from a heating medium is not limited only to the air but may be a fluid utilizing waste heat of cooling water, lubricating oil, etc. used in an engine.

FIGS. 25 to 30 show a sixth embodiment.

Figure 26:
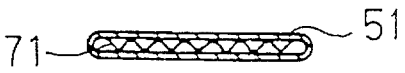
FIG. 26 is a sectional view of the tubes.
Figure 27:
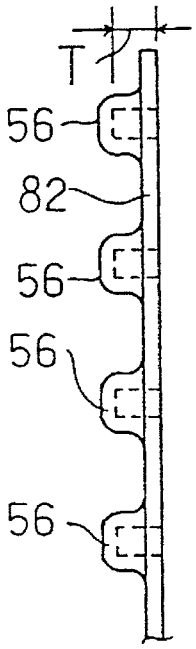
FIG. 27 is a side view of a capsule plate.
Figure 28:
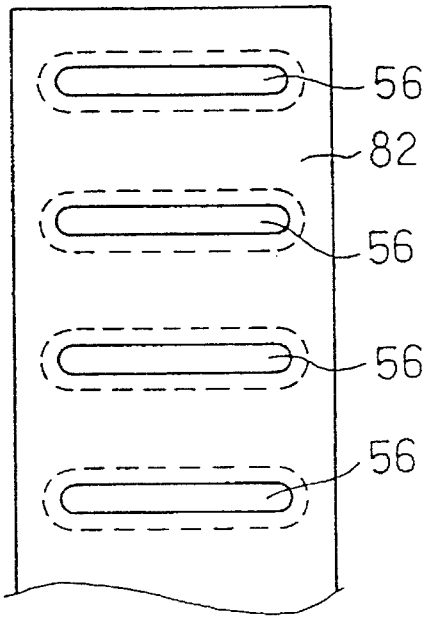
FIG. 28 is a front view of the capsule plate.
Figure 29:
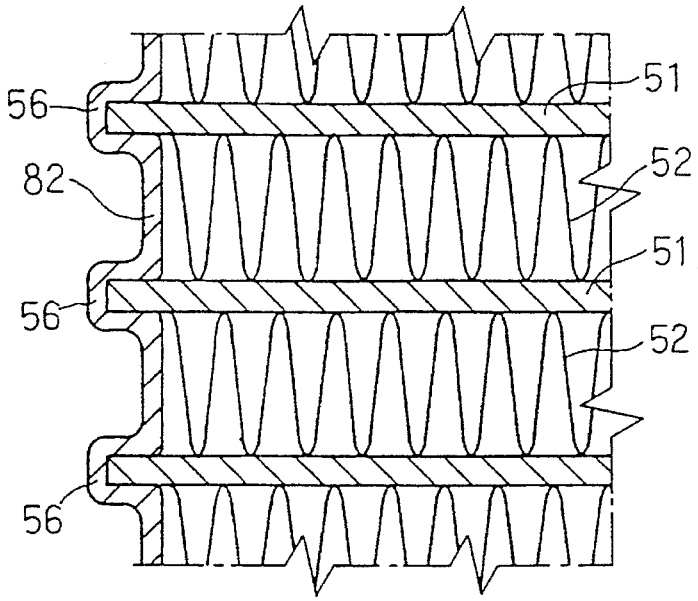
FIG. 29 is a sectional view of the coolant condenser including the capsule plate.

The tube 51 is an aluminum tube, which is of a flat, oblong sectional form as shown in FIG. 26, and includes the aluminum inner fins 71 inside. The inner fins 71 are joined integrally to the tube 51 at the time of brazing. The inner fins are produced of a sheet which is formed with a plurality of corrugations, that is, repetitively alternating ridges and grooves, in a direction meeting at right angles with the longitudinal direction of the tube 51, separating the interior of the tube 51 into a plurality of passages in which the coolant flows.

The length of the inner fins 71 in the longitudinal direction is set slightly shorter than the length of the tube 51 in the longitudinal direction; accordingly provided on one end of the tube 51 is a part S where no inner fin 71 is present.

A capsule plate 82 is an aluminum plate with a plurality of capsules 56 formed by pressing to cover one end (the side where no inner fin is present) of each tube 51 as shown in FIG. 25, 27, 28 and 29. Each capsule 56 is joined integrally to one end of each tube 51 at the time of brazing. Each capsule 56 of the capsule plate 82 covers one end of the tube 51 on the side where no inner fin 71 exists, thereby forming a communicating part 83, at which point the coolant turns, in the tube 51 where no inner fin 71 is present.

The length T (see FIG. 27) of the capsule 56 to cover one end of the tube 51 is equal to or greater than the length S (see FIG. 25) of the capsule 56 in a place where no inner fin 71 is present within the tube 51. The part of the tube 51 having no inner fin 71 is not fitted with inner struts formed of the inner fins 71 and therefore has low strength. According to the present embodiment, however, the part of the tube 51 where no inner fin 71 exists inside the tube 51 is fully covered with the capsule 56, which reinforces the part of the tube 51 where no inner strut is present. In consequence, the tube 51, if supplied with a high-pressure coolant, can fully withstand the high pressure even in the part S where no inner fin 71 is used.

The header 54 is of a separate type built by joining a plurality of aluminum members, comprising, as shown in FIGS. 25 to 30, an inner plate 84 of approximately C-shaped section in which the side plate 53 and a plurality of tubes 51 are inserted, an outer plate 85 of approximately C-shaped section joined to this inner plate 84 into a cylindrical form, and a comb-type separator 66 for separating the interior of the header 54 into the inlet chamber 64 and the outlet chamber 65, and covered at both ends with the caps 61 (illustrated in FIG. 3). Joined to this outer plate 85 by brazing are the inlet pipe 62 connected to a piping for leading the coolant to the inlet chamber 64 and the outlet pipe 63 connected to a piping for leading the coolant outside of the outlet chamber 65. In each recess 86 provided in the separator 66 (see FIG. 30) is fitted the other end of the tube 51.

Figure 30:
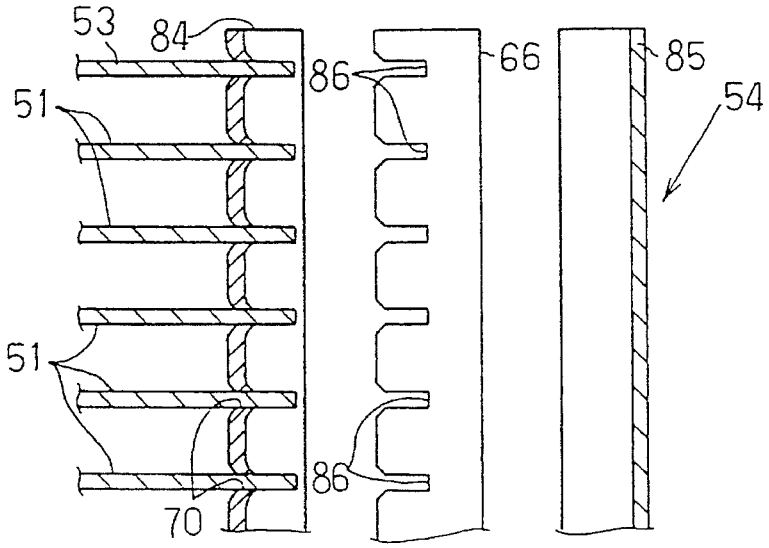
FIG. 30 is an exploded view of the header.

The header 54 is installed by the following procedure. As shown in FIG. 30, of the laminated tubes 51 and corrugated fins 52, the end of each tube 51 is inserted in the tube insertion hole 70 of the inner plate 84. Then, each recess 86 of the separator 66 is fitted over the end of each tube 51. Subsequently, the outer plate 85 is installed to the inner plate 86, thus completing the installation of the cylindrical part of the header 54. Thereafter the cap is installed on either end of the cylindrical part and then the inlet pipe 62 and the outlet pipe 63 are connected to the outer plate 85, completing the installation of the header 54.

Figure 25:
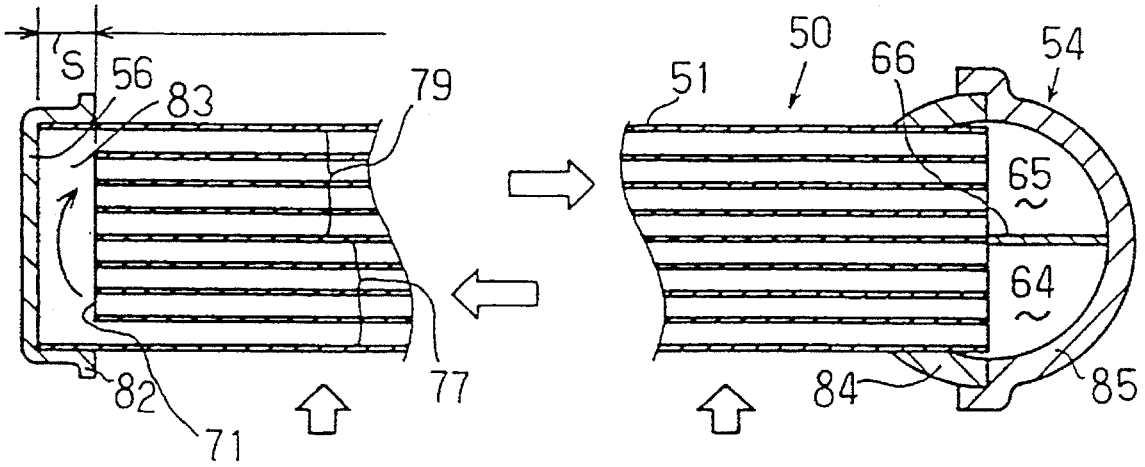
FIG. 25 is a sectional view showing a sixth embodiment of the coolant condenser.

The interior of the tube 51, as described above, is separated by a plurality of inner fins 71 to form a plurality of passages, and is provided with a communicating section 83 at one end. The other end of the tube 51, as shown in FIG. 25, opens to the inlet chamber 64 and the outlet chamber 65 within the header 54. Therefore, of a plurality of passages, the passage communicating with the inlet chamber 64 becomes the inlet passage 77 for flowing the coolant in one direction of the tube 51, while the passage communicating with the outlet chamber 65 becomes the outlet passage 79 for flowing the coolant to the other end side of the tube 51.

The tube 51 used in the coolant condenser 50 of the present embodiment has a communication section 83 in one end thereof by closing the one end with the capsule 56 of the capsule plate 82 with the short inner fin 71 inserted into the tube 51, thereby facilitating the manufacture of the tube 51 having the communicating section 83 as compared with prior-art tubes. Thus it is possible to reduce the manufacturing cost of the tube 51, resulting in the reduction of the production cost of the coolant condenser 50.

The coolant condenser 50, having only one header 54, has a large ratio of effective heat exchange surface area of the tubes 51 and the corrugated fins 52 to the total area of the front surface of the coolant condenser 50 as compared with a prior-art coolant condenser having two headers. Accordingly, it is possible to increase the condensing capacity of the coolant condenser 50 more than the condenser having two headers.

Figure 31:
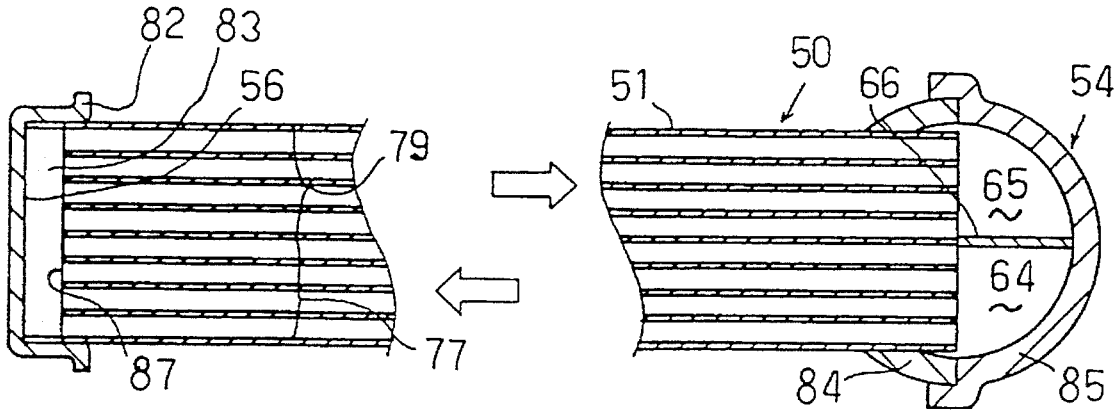
FIG. 31 is a sectional view of a seventh embodiment of the coolant condenser.
Figure 32:
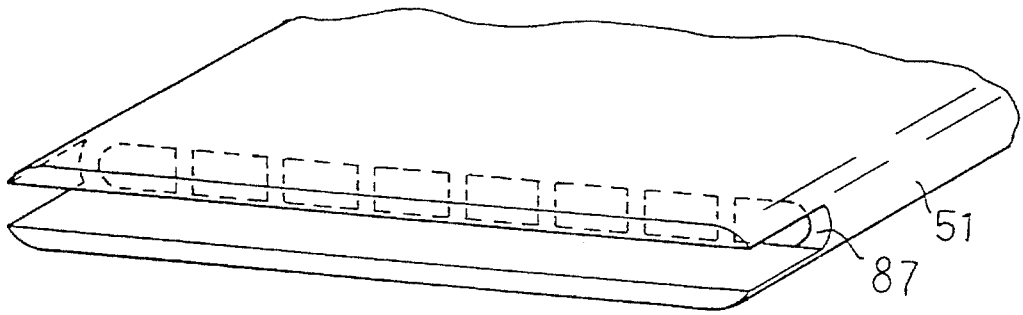
FIG. 32 is a perspective view of one end of the tubes.

FIGS. 31 and 32 show a seventh embodiment, in which FIG. 31 is a sectional view showing a major portion of the coolant condenser 50.

The tube 51 of the present embodiment is extrusion-molding so that a plurality of passages will be formed inside. Of the passages the passage communicating with the inlet chamber 64 serves as the inlet passage 77, while the passage communicating with the outlet chamber 65 is the outlet passage 79.

One end of the tube 51, as shown in FIG. 32, is provided with a channel-like groove (cut section) 87 by cutting throughout each passage, thereby forming a portion at the end of the tube 51 where no inner strut is provided. The capsule 56 of the capsule plate 82 covers the end of the tube 51 and the end of the groove 87, to thereby form the interior of the groove 87 as the communicating section 83.

In the present embodiment, a plurality of passages are formed in the tube 51 by extrusion molding. At one end of the tube 51 is provided the groove 87 and one end of the tube 51 is closed with the capsule 56, thus forming the communicating section 83 in one end of the tube 51. Therefore, it is possible to facilitate the manufacture of the tube 51 having the communicating section 83 as compared with the prior-art tubes, resulting in a lowered manufacturing cost of the tubes 51 and consequently in a decreased manufacturing cost of the coolant condenser 50.

Figure 33:
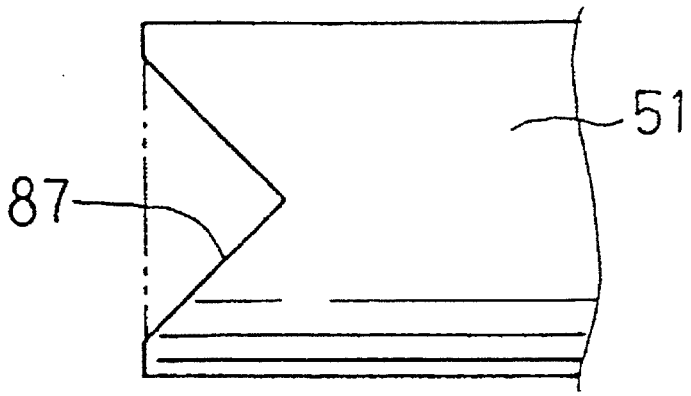
FIG. 33 is a side view of the tubes.

FIG. 33 is a side view of the end section of the tube 51 according to the present invention.

Figure 34:
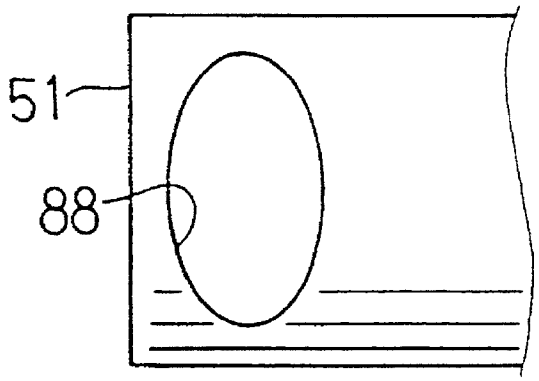
FIG. 34 is a side view of the tubes.

The tube 51 of the present invention, like the seventh embodiment, may be produced through extrusion molding, having a plurality of passages inside. The tube 51 is provided at one end with a V-groove (cut section) 87 throughout each passage, and one end of this tube 51 and the end of the groove 87 are closed with the capsule (refer to the seventh embodiment), thereby providing a communicating section (refer to the seventh embodiment). Tube 51 may also be provided with an elliptical opening 88 as shown in FIG. 34.

In the above-described embodiment, the capsule plate was mounted separately from the side plate, but may be provided integrally with the side plate, to thereby decrease the number of component parts of the heat exchanger and to insure easy and reliable holding the tubes and the corrugated fins.

In the above example each capsule is formed integrally with a plate, but there may be separately provided a capsule covering one end of the tube.

There may be adopted a header of other construction than the above-described of the invention. The heat exchanger of the present invention applied to the coolant condenser has been described hereinabove, but may be applied to various heat exchanges such as a coolant evaporator, radiator, heater core, oil cooler, etc.

It is to be understood that the above description of the present invention is susceptible to various modifications, changes and adaptations within the spirit and scope of the appended claims.

What is claimed is:

1. A heat exchanger, comprising:

a plurality of tubes in which a heating medium flows in a longitudinal direction; and one header having an inlet chamber for flowing the heating medium into said tubes, an outlet chamber for flowing the heating medium from inside of said plurality of tubes, and a partitioning means, fixed to and extending from a first wall of said header to a second wall opposite said first wall, for separating said inlet chamber and said outlet chamber in two stages in the longitunal direction of said plurality of tubes, with an end of said plurality of tubes inserted through said partitioning means.

2. A heat exchanger as claimed in claim 1, wherein inner fins are provided, in said plurality of tubes, with a plurality of small-diameter passages formed in parallel with the longitudinal length of said plurality of tubes, and with inner fins for heat exchange between the heating medium flowing in a part of said plurality of small-diameter passages and the heating medium flowing in the other part of said plurality of small-diameter tubes.

3. A heat exchanger as claimed in claim 2, wherein an inlet port connecting said inlet chamber with a part of said plurality of small-diameter passages are open into said inlet chamber in the surface on one end of said plurality of tubes; and outlet ports are opened on said the back side on one end side of said plurality of tubes within said outlet chamber, for communicating said outlet chamber with the other one of said small-diameter passages of said plurality of small-diameter passages.

4. A heat exchanger according to claim 1, wherein a terminal end of a group of said plurality of tubes airtightly contacts said partition.

5. A heat exchanger according to claim 1, wherein at least one of said inlet port and said outlet port is contained in a plane perpendicular to said partition.

* * * * *